United States Patent [19]

Rachel

[11] 4,327,689

[45] May 4, 1982

[54] COMBINED WARM-UP ENRICHMENT, ENGINE ROUGHNESS AND EXHAUST GAS SENSOR CONTROL FOR EFI ENGINE

[75] Inventor: Todd L. Rachel, Tournefeuille, France

[73] Assignee: The Bendix Corporation, Southfield, Mich.

[21] Appl. No.: 81,512

[22] Filed: Oct. 3, 1979

[51] Int. Cl.[3] ..... F02D 5/00

[52] U.S. Cl. ..... 123/436; 123/440; 123/489; 123/491

[58] Field of Search ..... 123/436, 440, 438, 479, 123/489, 491, 419, 179 L, 179 G; 60/276

[56] References Cited

U.S. PATENT DOCUMENTS

| | | | |
|---|---|---|---|
| T960,002 | 7/1977 | Moon | 123/436 |
| 3,734,068 | 5/1973 | Reddy | 123/32 EA |
| 3,745,768 | 7/1973 | Zechnall et al. | 123/440 |
| 3,771,502 | 11/1973 | Reddy | 123/32 EA |
| 3,938,479 | 2/1976 | Oberstadt | 123/32 EA |
| 3,971,354 | 7/1976 | Luchaco et al. | 123/179 L |
| 4,003,350 | 1/1977 | Eisele et al. | 123/489 |
| 4,092,955 | 6/1978 | Reddy | 123/436 |
| 4,109,615 | 8/1978 | Asano | 123/491 |
| 4,136,645 | 1/1979 | Ito et al. | 123/440 |
| 4,271,798 | 6/1981 | Seitz et al. | 123/436 |

*Primary Examiner*—Charles J. Myhre
*Assistant Examiner*—Andrew M. Dolinar
*Attorney, Agent, or Firm*—Gaylord P. Haas, Jr.; Bruce L. Lamb; James R. Ignatowski

[57] ABSTRACT

In an electronic fuel injection system for an internal combustion engine an oxygen sensor tests the exhaust gas for oxygen content and provides a feedback signal for fuel/air mixture control. During cold start and engine warm-up the oxygen sensor is inoperative and mixture is controlled as a function of engine coolant temperature. During this phase the mixture may be excessively lean causing rough engine running. Means responsive to cylinder misfirings temporarily enrich the mixture to eliminate engine roughness.

7 Claims, 2 Drawing Figures

COMBINED WARM-UP ENRICHMENT, ENGINE ROUGHNESS AND EXHAUST GAS SENSOR CONTROL FOR EFI ENGINE

The present invention relates to a combined warm-up enrichment means, engine roughness sensor and exhaust gas sensor for controlling the quantity of fuel delivered to an internal combustion engine by an electronic fuel injection system.

Electronic fuel injection systems for controlling air/fuel ratio of the combustion mixture for internal combustion engines are well known. Earlier systems metered fuel to the engine by varying the fuel injector pulsewidths or open times according complex functions of sensed engine parameters such as speed, manifold absolute pressure, throttle position, etc. More recently such systems have been improved by the addition of an exhaust gas sensor providing a feedback signal to the injector pulsewidth control unit to maintain the air/fuel mixture near the stoichiometric point. Typically, exhaust gas sensors detect the presence or absence of oxygen in the engine exhaust and consequently signal only whether the air/fuel mixture is leaner or richer than stoichiometric. The basic quantity of fuel injected per engine cycle continues to be determined as a complex function of sensed engine parameters and the exhaust gas or oxygen sensor is given authority to vary the quantity by the order of 10–12% to maintain the mixture near stoichiometric.

It has been recognized that the exhaust gas sensor must reach full operating temperature before it produces reliable signals. In U.S. Pat. No. 3,938,479 issued Feb. 17, 1976 to Oberstadt for "Exhaust Gas Sensor Operating Temperature Detection System" means are provided which prevent the sensor from exerting control until its internal impedance has changed in such a manner as to indicate that proper operating temperature has been reached. Alternatively, as indicated in U.S. Pat. No. 3,938,479 means may be provided for monitoring the engine coolant temperature and preventing the exhaust gas sensor from exerting control until the coolant temperature reaches the normal operating level.

It is well known that a cold engine requires mixture enrichment for satisfactory operation. In U.S. Pat. No. 3,771,502 issued Nov. 13, 1973 to Reddy for "Circuit for Providing Electronic Warm-Up Enrichment Fuel Compensation Which is Independent of Intake Manifold Pressure In An Electronic Fuel Control System" there is described means for increasing the pulsewidths of fuel injector signals as an inverse function of engine temperature.

The present invention combines the output of a warm-up enrichment circuit similar to that described in U.S. Pat. No. 3,771,502 with the output of an exhaust gas sensor to control the pulsewidths of the fuel injector in such manner that the particular one of the two control outputs having the greatest momentary magnitude exercises exclusive authority of the mixture enrichment.

The mixture enrichment required for the cold engine warm-up period substantially exceeds the percentage mixture variation to maintain the mixture stoichiometric. To avoid engine misfire, prior fuel injection systems calibrated the system excessively rich during warmup and disabled the controls intended to optimize the mixture until full operating temperature was reached. Such an excessively rich mixture reduces economy and increases emissions. If an exhaust gas sensor is used to control the mixture during warmup, as well as at full operating temperature, the problem described in U.S. Pat. No. 3,938,479 is encountered wherein the exhaust gas sensor below its normal operating temperature produces false signals and causes excessive leaning of the mixture to the point of engine misfire. In the present invention enrichment provided during most of the warm-up period, although decreasing with temperature, remains at a level exceeding the authority of the exhaust gas sensor. Therefore, the combination of the outputs of the warm-up enrichment circuit and the exhaust gas sensor in the manner provided by this invention overcomes the problem, associated with an exhaust gas sensor operating below its normal temperature and further provides for an earlier assumption of authority by the exhaust gas sensor than would occur if the exhaust gas sensor were prevented from operation until the engine reaches full operating temperature. However, as the engine nears normal operating temperature the authority of the warm-up enrichment circuit approaches that of the exhaust gas sensor and the authority of the exhaust gas sensor may prevail at a time when a tendency of the exhaust gas sensor to lean the mixture would cause misfire of the cylinders and consequent roughness of engine operation.

The invention therefore provides sensitive means for detecting cylinder misfires and utilizes the output of such detector to cause enrichment of the mixture to the point where cylinder misfire does not occur.

Accordingly, it is an object of the present invention to provide means for controlling the quantity of fuel delivered to an engine by an electronic fuel injection system as a combined function of engine temperature, exhaust gas composition and engine roughness.

It is another object of the invention to provide sensitive means for detecting cylinder misfires whereby an electronic fuel injection system with exhaust gas sensing may be controlled to reduce engine roughness due to an excessively lean mixture.

BRIEF DESCRIPTION

Briefly the invention provides a cylinder misfire detector which includes a flip-flop triggered by the current pulses to the primary of the engine ignition coil. The flip-flop alternately switches on and off a constant current source and a constant current sink for charging and discharging a capacitor. Whenever a misfire occurs the engine speed decreases an incremental amount, increasing the period between switching signals and increasing the average value of the voltage across the capacitor. The capacitor voltage is added to the voltage from an engine temperature sensing network to provide an enrichment factor voltage. The output of an oxygen sensor exposed to the engine exhaust is integrated and compared with the enrichment factor voltage. The particular one of these two voltages having the greatest magnitude is then added to a reference voltage and the result is used to control a current source in a known circuit for generating fuel injector pulses.

THE DRAWINGS

In the draawings:

DETAILED DESCRIPTION

Figure 1:
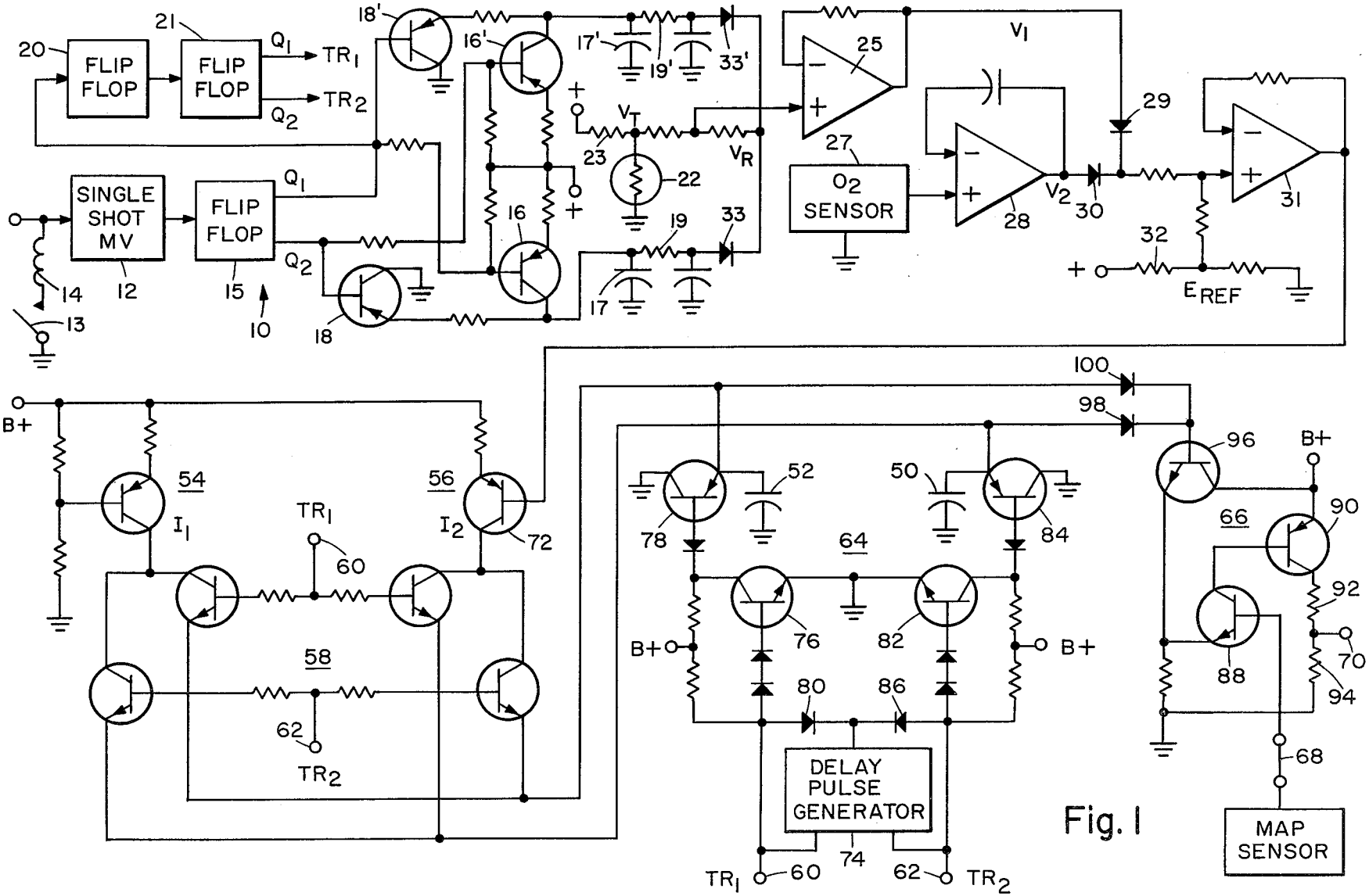
FIG. 1 is a functional block diagram partially in schematic form, showing the combined engine roughness sensor, warm-up enrichment circuit and exhaust gas sensor of the invention used to control a fuel injector pulse generator.

Referring to FIG. 1, the cylinder misfire detector 10 includes a single shot multivibrator 12 which is triggered each time the engine ignition points 13 close to deliver current to the ignition coil primary 14. Multivibrator 12 delivers clean triggering pulses to a flip-flop 15 which alternately sets and resets upon sequential triggering. Flip-flop 15 provides outputs $Q_1$ and $Q_2$ which alternate between high and low states in complimentary fashion as set and reset occurs. Transistor 16 delivers current at a constant rate to a capacitor 17 whenever output $Q_1$ of flip-flop 15 is low. Transistor 18 sinks current from capacitor 17 at a constant rate whenever output $Q_2$ of flip-flop 15 is low. A similar current source-sink circuit comprising transistors 16' and 18' is connected in opposite phase to outputs $Q_2$ and $Q_1$ to alternately charge and discharge capacitor 17'. Thus a triangular voltage waveform having a constant average value is developed across capacitor 17 so long as the period between ignition pulses is constant. A similar triangular waveform, but of opposite phase, is developed across capacitor 17'. Resistor-capacitor type filters 19 and 19' provide the average values of the voltages across capacitors 17 and 17'. When a cylinder misfires, the engine speed decreases incrementally and the period between ignition pulses increases, resulting in a change of these average values. Since a misfire may occur at either phase of flip-flop 15, i.e. when $Q_1$ is either high or low, the change in the average values of voltages across capacitors 17 and 17' can be of either positive or negative polarity. As will later be seen, a voltage of positive polarity is arbitrarily chosen as the sense of control signal to cause enrichment. An "or" circuit comprising diodes 33 and 33', having cathodes connected in common and anodes respectively connected to filters 19 and 19' selects only the positive one of the capacitor average voltage values for utilization by the system.

The $Q_1$ output of flip-flop 15 triggers a second flip-flop 20 which in turn triggers a third flip-flop 21. Outputs $Q_1$ (TR1) and $Q_2$ (TR2) of flip-flop 21 are complementary square waves having a period equal to the period of an engine cycle (two crank revolutions), presuming an eight cylinder engine. If the engine has fewer than eight cylinders, other obvious division arrangements would be made to produce the TR1 and TR2 waves.

Waves TR1 and TR2 are synchronizing signals for the fuel injector pulses, as later described herein, and as more completely described in U.S. Pat. No. 3,734,068 issued May 22, 1973 to Reddy for "Fuel Injection Control System".

Warm-up enrichment is provided by an engine temperature sensing network comprising a thermistor 22 and a resistor 23 connected as a voltage divider between B+ and ground. Thermistor 22 is exposed to the engine coolant and has a negative temperature coefficient so that the voltage developed thereacross is an inverse function of engine temperature. This temperature dependent voltage is added, in an operational amplifier 25, to the positive average voltage selected by a diode 33 or 33'. The output $V_1$ of amplifier 25 is: $V_1=K_1(V_T+V_R)$, where $K_1$ is the gain of amplifier 25; $V_T$ is the temperature dependent voltage across thermistor 22; and $V_R$ is the roughness dependent voltage produced by filters 19 or 19'.

An oxygen sensor 27, exposed to the engine exhaust, provides a substantially constant, relatively high level signal in the absence of oxygen and a substantially constant, low level signal in the presence of oxygen. The output of sensor 27 is integrated in an operational amplifier 28 with capacitive feedback providing an output $V_2$ which is: $V_2=K_2E(1/s)$, where $K_2$ is the gain of integrator 28; E is the output voltage of sensor 27; and s is the LaPlace operator.

Outputs $V_1$ and $V_2$ are applied, respectively, through diodes 29 and 30 to one input of an operational amplifier 31. A bias voltage, customarily referred to as $E_{REF}$, from a voltage divider 32 is also applied to an input of amplifier 31. The action of diodes 29 and 30 is to select whichever of the outputs $V_1$ and $V_2$ has the greatest magnitude and apply the same to amplifier 31. The output $V_1$ and $V_2$ having the lower magnitude is blocked. The output of amplifier 31 controls the constant current source 56 in the injector pulse generator next to be described and which is described in more detail in the aforementioned U.S. Pat. No. 3,734,068.

Current source 54 is a constant current source capable of charging capacitors 50 and 52 at a predetermined rate to a predetermined value. Current source 56 is also a constant current source having a constant current output signal operative to charge capacitors 50 and 52 at a predetermined rate to potentials well above the predetermined value of current source 54. The trigger signals TR1 and TR2 in the form of two alternating square waves are respectively applied to input terminals 60 and 62 of switch 58 and control the sequential charging of the capacitors 50 and 52 by the two current sources 54 and 56. In the interval when the signal TR1 is positive and the signal TR2 is negative or a ground potential, capacitor 52 is charged by current source 54 and capacitor 50 is charged by current source 56. When the trigger signals reverse polarity, the two capacitors are charged by the alternate current source.

The leading edges of the trigger pulses TR1 and TR2 applied to the discharge circuit 64 activates a delay pulse generator 74, such as a single shot multivibrator which generates a delay pulse having a predetermined pulsewidth significantly shorter than pulsewidth of the trigger pulse. A positive trigger signal on input terminal 60 coincident with the positive delay pulse signal removes the effective ground potential on the base of transistor 76 causing it and transistor 78 to conduct. Transistor 78 discharges capacitor 52 to near ground potential during the period of the delay pulse. Termination of the delay pulse returns a ground potential at the output of the delay pulse generator 74 which is applied to the base of transistor 76 through diode 80. The ground signal at its base blocks transistor 76 which in turn blocks transistor 78 permitting capacitor 52 to be charged by current source 54 to the perdetermined value. When the trigger signals TR1 and TR2 change polarity, a positive potential is applied to terminal 62 and the delay pulse permits the base of transistor 82 to be forward biased and capacitor 50 is discharged by means of transistor 84 in a manner equivalent to the way capacitor 52 was discharged. The switching network 58 also changes state in response to the inversion of the trigger signals and capacitor 52 is charged from current source 56 and capacitor 50 is charged from current source 54.

The pressure signal applied to pressure input terminal 68 forward biases transistor 88 which in turn forward biases transistor 90. The conduction of transistor 90 produces a positive potential at output terminal 70 which is connected to the junction between resistances 92 and 94 forming a voltage divider network between the collector of transistor 90 and ground. Pulses from output terminal 70 are applied through a power amplifier (not shown) to the fuel injectors (not shown).

The conduction of transistor 88 also biases the emitter of transistor 96 to a potential approximately equal to the value of the pressure signal appearing at terminal 68. The charge signals on capacitor 50 and 52 are applied to the base of transistor 96 through diodes 98 and 100, respectively. When the signals on both capacitors have a potential value below the value of the pressure signal, transistor 96 is blocked. However, when the potential value on either capacitor 50, 52 or both exceed the value of the pressure signal, transistor 96 conducts. Conductance of transistor 96 raises the value of the potential appearing at the emitter of transistor 88 above the value of the pressure signal applied to its base thereby blocking transistor 88. Blocking of transistor 88 blocks transistor 90 and with transistor 90 in the blocked state, the potential at output terminal 70 assumes a ground potential terminating the output signal.

Figure 2:
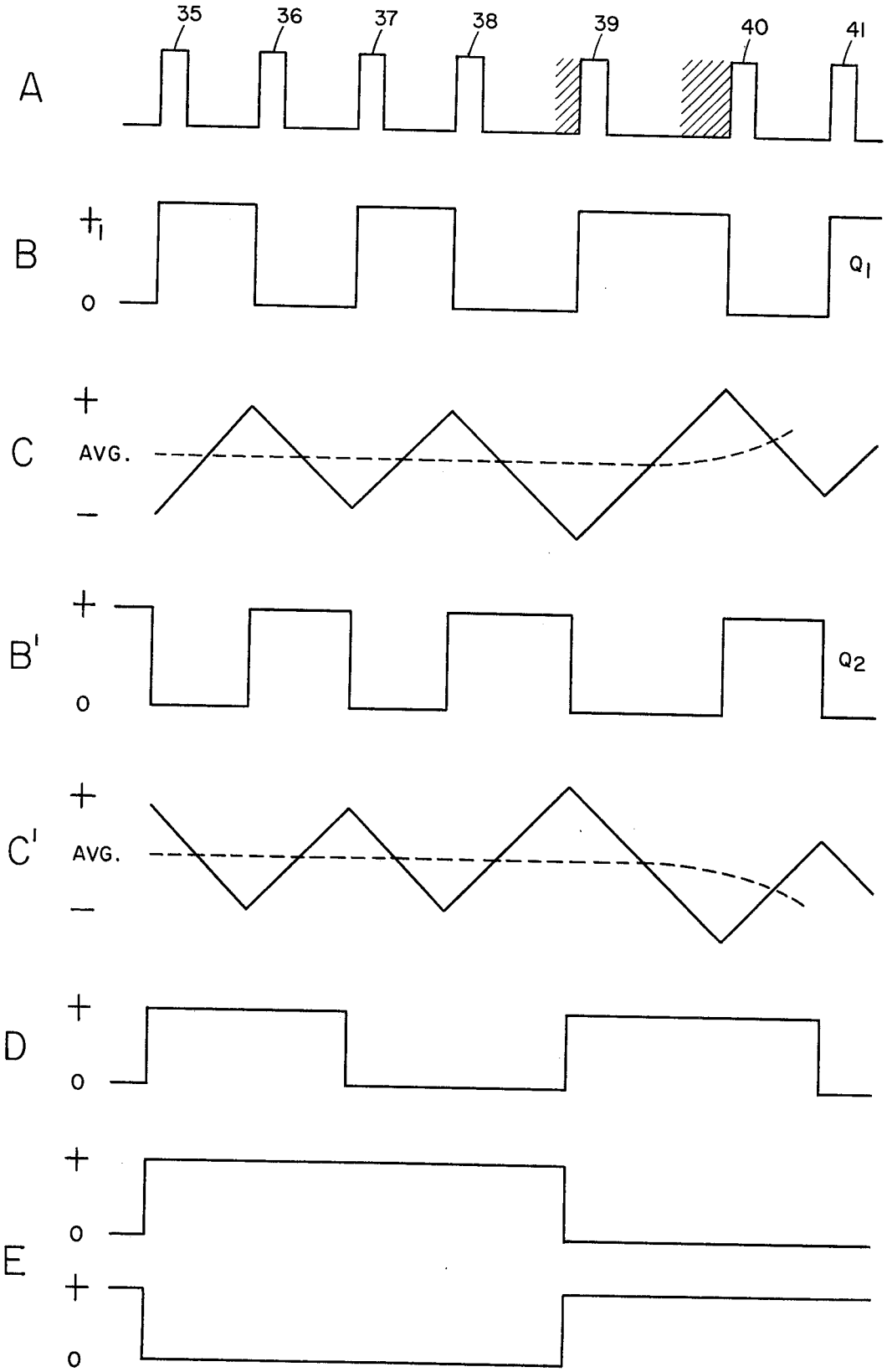
FIG. 2 is a waveform diagram of signals appearing at various points in FIG. 1.

FIG. 2 illustrates waveforms at various points in the circuit of FIG. 1. FIG. 2A shows the output of multivibrator 12 with each of the pulses there being triggered by an ignition pulse. FIG. 2B shows the $Q_1$ output of flip-flop 15. FIG. 2C shows the voltage across capacitor 17 with constant charging rate when the output $Q_1$ of flip-flop 15 is high and an equal discharge rate when output $Q_1$ of flip-flop 15 is low. FIG. 2B' shows the $Q_2$ output of flip-flop 15. FIG. 2C' shows the waveform of the voltage developed across capacitor 17', similar to that of FIG. 2C, but of opposite phase. FIG. 2D shows the output of flip-flop 20 and FIG. 2E shows the injector synchronizing pulses TR1 and TR2.

In FIG. 2A, the cylinders receiving ignition pulses 35, 36 and 38 fire regularly. The cylinder receiving ignition pulse 38 misfires due to an excessively lean mixture. The misfire results in an incremental decrease in torque and engine speed causing the period between ignition pulse 38 and the succeeding ignition pulse 39 to increase by an amount represented by the shaded area. The cylinder receiving ignition pulse 39 likewise misfires, causing a further increase in the period between ignition pulse 39 and the following pulse 40. The average value of the triangular wave in FIG. 2C, shown by the dashed line, is zero during the interval of the constant period of the square wave in FIG. 2B. The lengthening periods between pulses 38-39 and 39-40 causes the average value of the wave in FIG. 2C to increase in a positive sense. Similarly the average value of the wave in FIG. 2C', shown by the dashed line, increases in a negative sense. The positive average value of the wave in FIG. 2C causes the voltage at diode 29 (FIG. 1) to be of greater magnitude than the voltage at diode 30, overcoming the effort of sensor 27 to lean the mixture. The mixture will be enriched, reducing misfires and restoring engine speed until the increased average value of voltage across capacitor 17 decays its original value. At that time sensor 27 will again assume authority and control the mixture.

The invention claimed is:

1. In an internal engine having an ignition system generating an ignition cycle, a combined warm-up enrichment, engine roughness sensor and exhaust gas sensor control circuit comprising:

temperature sensing means for sensing the engine operating temperature and providing an output tending to reduce the engine fuel/air ratio as engine temperature increases;

misfire detecting means for detecting engine misfire and providing an output tending to increase the engine fuel/air ratio when misfire occurs;

exhaust gas sensing means for sensing the composition of the engine exhaust gas and providing an output tending to maintain the engine fuel/air mixture stoichiometric;

means for combining the outputs of said temperature sensing means and said misfire detecting means;

means for selecting either said combined outputs or the output of said exhaust gas sensing means for control of the engine fuel/air ratio according to whichever of said combined outputs or said exhaust gas sensing means output possesses the greater magnitude; and means responsive to said selected output for varying the fuel/air ratio of said engine; and where said misfire detecting means comprises:

a bistable flip-flop having a pair of outputs which alternate in complementary states;

means synchronized with the ignition cycle for triggering said flip-flop into change of output states;

a capacitor;

means applying a constant charging current to said capacitor when one of said flip-flop outputs is in one state;

means for discharging current from said capacitor at a constant rate when said one flip-flop output is in the state complementary of said one state; and means providing the average value of the voltage developed across said capacitor.

2. The circuit of claim 1 wherein said selecting means comprises a pair of diodes, a similar electrode from each diode being connected together and providing at the common connection the selected output for control of said engine fuel/air ratio, said combined outputs being applied to the remaining electrode of one of said diodes, said exhaust gas sensing means output being applied to the remaining electrode of the other diode.

3. The circuit of claim 1 wherein said means for varing the fuel/air ratio of said engine includes;

a pulse generator, said pulse generator responding to said selected output by varying the duration of pulses produced thereby ; and fuel injector means for supplying fuel to the engine in response to the pulses produced by said pulse generator to vary the air/fuel ratio of said engine.

4. The circuit of claim 1 wherein engine temperature sensing means comprises a temperature sensitive voltage divider which provides an output voltage which varies in a first sense with increasing engine temperature and wherein said average value of the voltage developed across said capacitor varies in the sense opposite said first sense whenever the interval between state changes of said flip-flop outputs increases.

5. In an internal combustion engine having a crankshaft, a plurality of cylinders and electronic fuel injection means, a combined warm-up enrichment, engine roughness sensor and exhaust gas sensor circuit for controlling the operation of the fuel injection means, comprising:

temperature sensing means for sensing the engine operating temperature and providing an output which varies in a first sense with increasing temperature;

interval determining means for determining the interval between successive firings of the cylinders of the engine and providing an output which varies oppositely in sense to the output of said temperature sensing means whenever said interval increases;

oxygen sensing means for sensing the oxygen content of the engine exhaust gases and providing an output tending to maintain the engine fuel/air mixture stoichiometric;

means for combining the outputs of said temperature sensing means and said interval determining means to provide a combined output; and means for selecting according to whichever possesses the greater magnitude, either said combined output or said oxygen sensing means output for control of the fuel injection means; and wherein said interval determining means comprises:

a bistable flip-flop having a pair of outputs which alternate in complementary states for successive trigger inputs thereto;

means synchronized with the engine crankshaft for triggering said flip-flop;

a pair of capacitors;

independent means for supplying a constant charging current to each of said capacitors;

independent means for discharging a constant current from said capacitors;

said charging means for one of said capacitors being controlled by one of said flip-flop outputs, said discharging means for said one capacitor being controlled by the other of said flip-flop outputs;

said charging means for the other of said capacitors being controlled by said other of said flip-flop outputs, said discharging means for the other of said capacitors being controlled by said one of said flip-flop outputs, whereby said capacitors alternately charge and discharge for successive triggerings of said flip-flop but in opposite phase;

means providing the average values of the voltages across each of said capacitors; and means selecting the highest of said average values.

6. The circuit of claim 5 wherein said means providing the average values comprises a pair of low pass filters, each of which is connected to one of said capacitors.

7. The circuit of claim 6 wherein said means for selecting the highest of said average value comprises a pair of diodes, one electrode of each of said diodes being connected to one of said capacitors and, the other electrodes of said diodes being connected together and providing said selected highest average value at the common electrode connection.

* * * * *